US005816575A

United States Patent [19]

Keller

[11] Patent Number: 5,816,575

[45] Date of Patent: Oct. 6, 1998

[54] EXPANDED BLACKJACK CARD GAME AND METHOD

[75] Inventor: David R. Keller, Las Vegas, Nev.

[73] Assignee: Harry M. Weiss, Las Vegas, Nev.

[21] Appl. No.: 871,829

[22] Filed: Jun. 9, 1997

[51] Int. Cl.[6] ..... A63F 1/00

[52] U.S. Cl. ..... 273/292

[58] Field of Search ..... 273/274, 292, 273/303, 305

[56] References Cited

U.S. PATENT DOCUMENTS

| | | | |
|---|---|---|---|
| 5,174,549 | 12/1992 | Griffiths . | |
| 5,275,416 | 1/1994 | Schorr et al. . | |
| 5,454,570 | 10/1995 | Karal . | |
| 5,577,731 | 11/1996 | Jones | 273/292 |
| 5,632,485 | 5/1997 | Woodland et al. | 273/274 X |
| 5,636,843 | 6/1997 | Roberts | 273/292 |
| 5,673,917 | 10/1997 | Vancura | 273/292 |
| 5,702,106 | 12/1997 | Alvarez, Jr. | 273/292 |
| 5,713,573 | 2/1998 | Nazaryan | 273/292 |

*Primary Examiner*—William E. Stoll

*Attorney, Agent, or Firm*—Harry M. Weiss; Jeffrey D. Moy; Harry M. Weiss & Associates, P.C.

[57] ABSTRACT

A new type of Blackjack (21) game, table and method is disclosed wherein a number of betting options are provided for the Blackjack player. In addition to the standard betting option against the Dealer, a Dealer Bust option, a jackpot option where the Blackjack player can obtain over 1,000 to 1 return payout and several other betting options are provided to bet on various possible cards such as receiving a 3 or a 6, a 4 or 5, a 10, Jack Queen, King or Ace for one or both of the initial two cards.

84 Claims, 3 Drawing Sheets

BONUS HAND PAYOUTS

♠ AJ Spades _____ 1250 to 1
♣ AJ Clubs _____ 1250 to 1

10 J Q K A
One _____ 5 to 1
Paired _____ 25 to 1

4+5 or 3+6
One _____ 2 to 1
Two _____ 8 to 1

DEALER BREAKS _____ 5 to 2

EXPANDED BLACKJACK CARD GAME AND METHOD

FIELD OF THE INVENTION

This invention generally relates to card games and methods therefor and, more particularly, to Blackjack card games and methods therefor.

BACKGROUND OF THE PRIOR ART

In the past, various card games have been developed for social and gambling or gaming type uses.

A popular card game, especially for gambling or gaming uses is the card game known as Blackjack (or "21") wherein a blackjack player plays against a Dealer and the object is to beat the Dealer by either "Standing" or "Sticking" (not drawing a card that might cause the Blackjack player to "Bust" (go over 21) and hope that the Dealer will "Bust") or by receiving a cumulative point card total higher than the Dealer from the Blackjack player's received playing cards being as close to 21 as possible with 21 being the maximum permissible score. In other words, if the Blackjack player and Dealer each achieve a total not exceeding 21, then the highest total wins the bet. Blackjack is relatively simple to understand and is usually a faster and easier card game to play than, for example, the game of Poker, therefore, Blackjack, which can be played with the Dealer and only one Blackjack player, is, in most Casinos, even more popular than the conventional game of Poker which needs to be played with several players because each of the Poker players are competing against each other for one "pot" whereas each Blackjack player can win against the one Dealer. Thus, this game includes a Dealer and at least one Blackjack player. One or more Blackjack players playing against the Dealer are, in effect, individually competing to try to either obtain a better card score (for multiple playing cards that they are dealt) than the Dealer or to "Stick" or "Stand" after receiving a minimum of 2 cards and hope that the Dealer will "Bust", For example, Blackjack players seeing one of the two Dealer's initial cards which is turned up may decide not to draw any additional card because they will win the bet if the Dealer has to hit (the Dealer is required to draw if their point total is 16 or less) and the Dealer "Busts" (goes over 21). Blackjack players also have the option of splitting any pairs (i.e. a pair of 10s, a pair of 9s, etc.) Blackjack players have several options such as to double down (double their bet and receive only one more card), double their bet when they split a pair of cards, and can receive a 1.5 times their bet return if they receive an Ace and a 10 or picture card for their other card. A Blackjack player receiving a card score of more than 21 points has the so called "Bust" hand and automatically loses to the Dealer (and vice versa). The Dealer, after receiving the first 2 cards begins drawing one or more cards (if the first 2 cards are 16 or less) but only after each of the Blackjack players at the Dealer's table have completely played their hand. Therefore, the "House" or casino has the advantage because the Blackjack player or players must play and complete their hand first or before the Dealer. The Blackjack players at the table individually playing against the Dealer and also the Dealer must receive a minimum of 2 cards. Each of the Blackjack players individually playing against the Dealer (who is a representative of the "House" or Casino) have the option of "Sticking" after the receipt of their 2 initial cards which means that they will not receive any other cards or to draw one or more other cards from the Dealer and to continue until they are either satisfied with their card count score and stop drawing cards ("Sticking") or they have "Busted" (gone over the 21 point total). As is known in the Blackjack card game, picture cards (Jacks, Queens and Kings) each have a point card value of 10 points while Aces have a point card value of either 1 point or 11 points. The other cards namely 2s,3s,4s,5s,6s,7s,8s,9s, and 10s have a point card value equivalent to their face card value (i.e. respectively 2, 3, 4, 5, 6, 7, 8, 9, and 10). In all gaming or Casino establishments, Dealers have to draw when they receive a point card value of 16 or less and, in some Casinos or gaming establishments, when they receive a point card value of 17 or less where the 17 point card value is based upon using an Ace as an 11 point card value with one or more other cards (this is known as a "Soft 17"). While Blackjack or 21 is a relatively fast card game, this game is not very dynamic and becomes very boring when played for an extended period of time. For example, new younger Blackjack players are finding the game of 21 very boring because they have enjoyed the excitement of playing action packed video games and thus need more options and variations in the manner that 21 is now being played. Because of the small percentage difference in the odds of playing Blackjack against a Dealer (with only a few percentage points in favor of the Dealer (or the House)), the same (gaming) chip or chips are often passed from the Blackjack player to the Dealer (when the Blackjack player loses) and from the Dealer to the Blackjack player (when the Dealer loses to the Blackjack player). This passing chips back and forth routine will sometimes last for relatively long periods of time until either the Blackjack player starts losing more often than winning because of a streak of bad luck or because of the percentage of odds in favor of the Dealer (or the House) or because the Blackjack player receives a run of good luck and wins more hands against the Dealer over a somewhat limited period of time. Blackjack players faced with losing several bets in a row will often become upset and will seek to recoup their losses quickly by significantly increasing the amount of their bet. This often results in the Blackjack player losing even greater amounts of money and at a faster rate of loss.

As a result, the game of Blackjack, as it is presently played, is tedious (because there is usually one betting option—to beat the Dealer by either receiving a higher point score or to hope that the Dealer will "Bust") and does not generate much excitement or enthusiasm for the Blackjack player. Other betting options are needed for the Blackjack player other than to significantly increase the bet. Thus a Blackjack game is needed which would permit the Blackjack player to have a chance to win a large bet (as an option after losing a number of conventional bets to the Dealer) without the risk of losing a large bet that was the only previous option to try to promptly recoup a series of lost bets to the Dealer.

Attempts have been made to vary the game of Blackjack to a relatively minor degree wherein a Blackjack player could have more than one betting option (other than the Blackjack player's bet to receive a higher card total (not more than the maximum of 21) than the Dealer or to hope the Dealer "Busts"). However, these other attempts have not been successful because they do not provide a multitude of very exciting betting options combined with a large jackpot type of payout. U.S. Pat. No. 5,454,570 to Karal discloses a Blackjack card game method therein a Blackjack player has extended wagering opportunities after the Blackjack player's hand has reached a desired card count value. Specifically, the Blackjack player can bet on whether the Dealer will achieve a card count that would be higher (but not greater than 21) than the Blackjack player's hand. This supplemental bet or wager by the Blackjack player is prior to the Dealer revealing the Dealer's face down card. Predetermined odds on the different possible Dealer hand combinations are selected by the Blackjack player by the selection of the point card value of the Dealer's hand. Also, the Blackjack player can wager on the point card value of the Dealer's only face down card. Furthermore, the Blackjack player can bet on the point card value of the third Dealer card, etc. The odds presented in this U.S. Patent range from 10 to 1 (on an Ace being the Dealer down card or the next card to be drawn by the Dealer). Picture cards including 10s have a 2 to 1 betting ratio.

U.S. Pat. No. 5,275,416 to Schorr et al. also discloses a Blackjack card game method wherein a Blackjack player can bet an the Dealer's hand, the Blackjack player's hand or for a tie in the point count between the Dealer and the Blackjack player. The bet for the tie pays 9 to 1, the bet for the Blackjack player's hand is even money (1 for 1), and the bet on the Dealer's hand is 5 for 6 (five chips can be won on a 6 chip bet).

U.S. Pat. No. 5,174,579 to Griffiths discloses a Blackjack card game method wherein a separate bet can be made on whether the Dealer obtains exactly 21 or Busts. Disclosed therein is a discussion of Royal Match 21 involving a separate bet by the Blackjack player to have their 2 initial cards be of the same suit (i.e. clubs, diamonds, hearts and spades). A higher payout is for when the Ace and King is received by the Blackjack player in the same suit for the 2 initial cards, but there is no separate bet for the receipt of these two cards (only a payout if they happen to be received when a bet is made for the receipt of 2 initial cards of the same suit). Also disclosed therein is a reference to the U.S. Pat. No. 4,861,041 to Jones et al. wherein a separate bet is made to be eligible for certain specific jackpot hands (i.e. four 5s and an Ace or Ace, Two, Three, Four, Five and Six). Simply stated, prior attempts at providing more than one betting option to the Blackjack player did not give the Blackjack player an opportunity to bet and win a very large bonus (i.e. more than a thousand chips for each chip bet) as well as to bet on many different possible combinations that would pay more than a one chip payback for each one chip bet, but yet still provide the Blackjack player with, if desired, a straight bet to beat the Dealer.

Accordingly, a need existed for providing a new, exciting Blackjack card game and method that would provide a large (more than a thousand chips for each chip bet) jackpot betting option for the Blackjack player plus several other multiple times (from at least 2 to 1 to about 25 to 1) betting opportunities as well as other betting options including the basic straight (1 chip return or win per 1 chip) bet to beat the Dealer. Thus, there is a need for a dynamic Blackjack game that would provide a Blackjack player with three general type betting options (1) multiple bonus betting opportunities, (2) a bet for the Dealer to "Bust" and (3) a bet to beat the Dealer, Also, a need existed for a Blackjack game that would permit a Blackjack player to both, in effect, beat the Dealer and to bet on receiving what is considered to be bad or poor initial (2) cards and thereby have the double chance to win both bets (the bet on receiving the bad cards and the bet that whatever cards that were received (including the bad cards) would beat the Dealer. Consequently, a Blackjack player could, in effect, bet and win on receiving a negative type hand (2 bad initial cards) plus have the opportunity to win against the Dealer with these bad cards. This provides a betting option for Blackjack players who are on somewhat of a negative streak (receiving bad cards in repeated hands) as contrasted for receiving positive type cards (10s, Js, Qs, Ks or Aces). A further need existed for a Blackjack game wherein multiple betting options are provided for a Blackjack player wherein different betting options can all be interrelated with the same goal of receiving the best bet return such as by using part of the bet for a straight win against the Dealer, another portion of the bet to receive certain initial cards (multiple chip return bonus bets) while still having a chance to beat the Dealer and, if desired, a bet on the Dealer going Bust.

SUMMARY OF THE INVENTION

It is an object of this invention to provide an improved Blackjack card game and method.

It is a further object of this invention to provide an improved Blackjack card game and method that provides a Blackjack player with multiple betting options.

It is a still further object of this invention to provide an improved Blackjack card game and method that provides a Blackjack player with multiple betting options with each betting option providing a payback of more than a conventional one for one payback in a conventional Blackjack game.

It is another object of this invention to provide an improved Blackjack card game and method that provides a Blackjack player with a jackpot betting option wherein the Blackjack player can receive a winning return of more than 1,000 times the amount bet by the Blackjack player.

It is still another object of this invention to provide an improved Blackjack card game and method that provides a Blackjack player with multiple betting options with each betting option providing a payback, depending on the option selected and bet on, of from 2 times to over 1,000 times the amount bet by the Blackjack player.

It is still another object of this invention to provide an improved Blackjack card game and method that provides a Blackjack player with multiple betting options with a number of betting options providing a payback, depending on the option selected and bet on, of from 2 times to over 1,000 times the amount bet by the Blackjack player and with other betting options including a straight forward Blackjack player win option wherein the Blackjack player will receive a one for one return if they win (unless they receive a two card 21 dealt pair of cards where they would receive one and a half times their wager) and also a Dealer bust option where the Blackjack player will receive a 5 to 2 return if they bet for the Dealer to go Bust. In this bet, the Dealer cards are played out even if the Blackjack player or players playing against the Dealer have also received a Bust hand.

BRIEF DESCRIPTION OF THE PREFERRED EMBODIMENTS

In accordance with one embodiment of this invention, a method of playing Blackjack against a Dealer is disclosed comprising the step of: providing a Blackjack player with a jackpot betting option to make a bet and have a possibility of winning more than one thousand times the bet made by the Blackjack player.

In accordance With another embodiment of this invention, a method of playing Blackjack against the Dealer is disclosed comprising the step of: providing a Blackjack player with separate betting options to make a bet on receiving at least one card from an initial two cards received by the Blackjack player equal to one of a 4 and 5, one of a 3 and 6 and a selected one of a 10, a Jack, a Queen, a King and an Ace.

In accordance with still another embodiment of this invention, a method of playing Blackjack against a Dealer is disclosed comprising the step of: providing a Blackjack player with separate betting options to make a bet on receiving at least one card from an initial two cards received by the Blackjack player equal to one of a 4 and 5 and one of a 3 and 6.

In accordance with a still further embodiment of this invention, a method of playing Blackjack against a Dealer is disclosed comprising the step of: providing a Blackjack player with a betting option to make a bet on receiving at least one card from an initial two cards received by the Blackjack player equal to one of a 4 and 5.

In accordance with a still further embodiment of this invention, a Blackjack card game is disclosed comprising in combination: a Blackjack card table having a betting layout located on a surface portion of the Blackjack card table; the betting layout comprising a betting region for a Blackjack player to make a jackpot bet having a possibility of winning more than one thousand times the bet made by the Blackjack player.

In accordance with another embodiment of this invention, a Blackjack card game is disclosed comprising, in combination: a Blackjack card table having a betting layout located on a surface portion of the Blackjack card table; the betting layout comprising separate betting regions for a Blackjack player to make a bet on receiving at least one card from an initial two cards received by the Blackjack player equal to one of a 4 and 5, one of a 3 and 6 and a selected one of a 10, a Jack, a Queen, a King and an Ace In accordance with still another embodiment of this invention, a Blackjack card game is disclosed comprising, in combination: a Blackjack card table having a betting layout located on a surface portion of the Blackjack card table; the betting layout comprising a separate betting region for a Blackjack player to make a bet on receiving at least one card from an initial two cards received by the Blackjack player equal to one of a 4 and 5 and another separate region for the Blackjack player to make a bet on receiving at least one card from an initial two cards received by the Blackjack player equal to one of a 3 and 6.

In accordance with a still further embodiment of this inventions. A Blackjack card game is disclosed comprising, in combination: a Blackjack card table having a betting layout located on a surface portion of the Blackjack card table; the betting layout comprising a separate betting region for a Blackjack player to make a bet on receiving at least one card from an initial two cards received by the Blackjack player equal to one of a 4 and 5.

In accordance with a further embodiment of this invention, a Blackjack card game is disclosed comprising, in combination: a Blackjack card table having a betting layout located on a surface portion of the Blackjack card table; the betting layout comprising a separate betting region for a Blackjack player to make a bet on receiving at least one card from an initial two cards received by the Blackjack player equal to one of a 3 and 6.

In accordance with another embodiment of this invention, a Blackjack card game is disclosed comprising, in combination: a Blackjack card table having a betting layout located on a surface portion of the Blackjack card table; the betting layout comprising separate betting regions for a Blackjack player to make a bet on receiving at least one card from an initial two cards received by the Blackjack player equal to a selected one for each of the separate betting regions of a 10, a Jack, a Queen, a King and an Ace.

In accordance with still another embodiment of this invention, a method of playing Blackjack against a Dealer is disclosed comprising the step of: providing a Blackjack player with a betting option to make a bet on receiving at least one card from an initial two cards received by the Blackjack player equal to a selected one of a 10, a Jack, a Queen, a King and an Ace.

The foregoing and other objects, features and advantages of this invention will be apparent from the following more particular description of the preferred embodiments of the invention as illustrated in the accompanying drawings.

DESCRIPTION F THE SPECIFICATION

Figure 1:
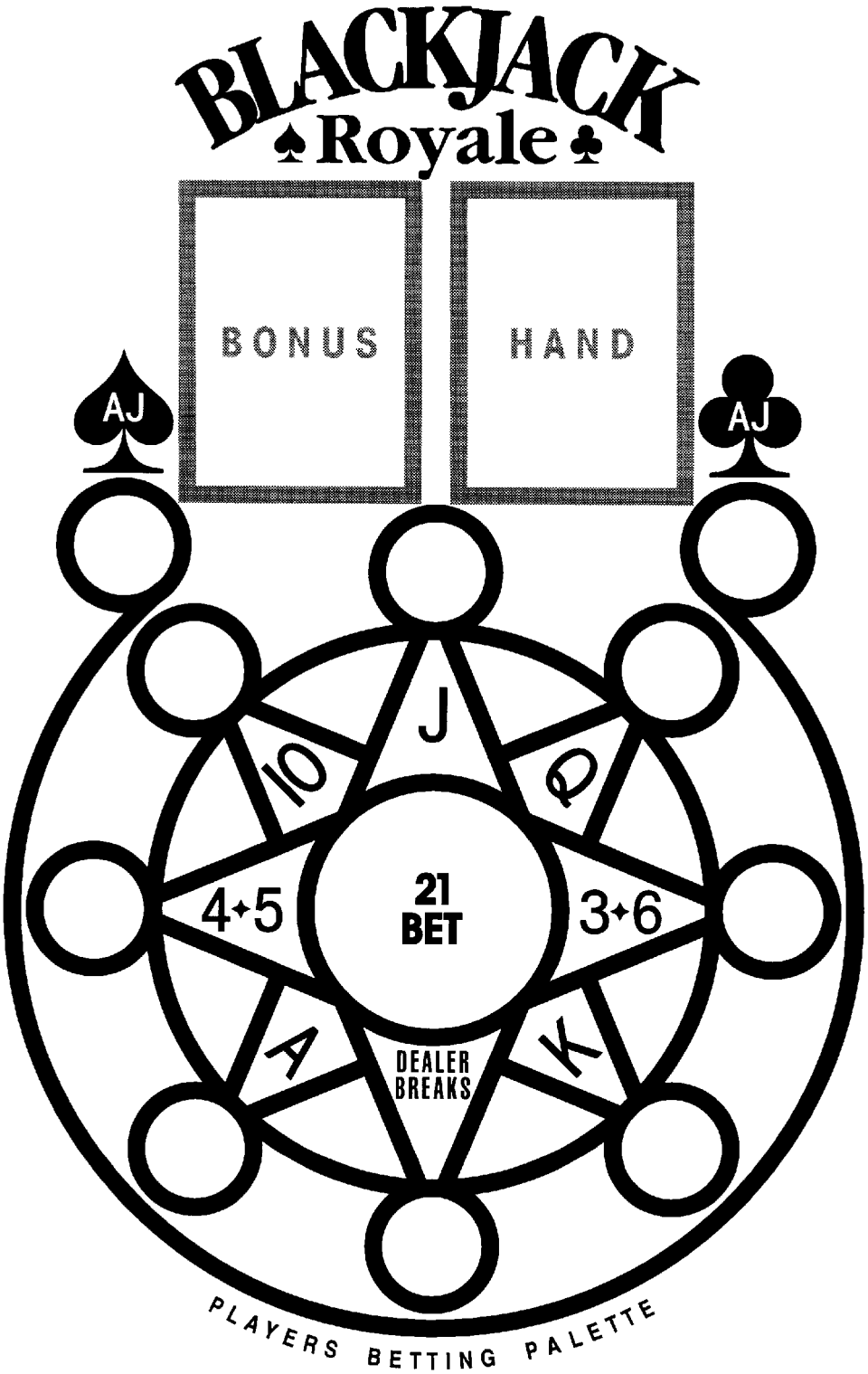
FIG. 1 is a top view of a player's betting palette located on a table of the Blackjack game and using the method of this invention.

Referring to FIG. 1, a player's betting palette is shown as located on a surface of a Blackjack game or table. The player's betting palette shown in FIG. 1 comprises a number of different betting options for a Blackjack player. To achieve the highest possible payout a Blackjack player can place a bet in either or both circular region or regions below a spade symbol (with the AJ (Ace Jack) designation therein) and/or a club symbol (with the AJ (Ace Jack) designation therein). The Blackjack player's first two initial cards are preferably located in the BONUS HAND regions with preferably one of the first two initial cards in one of these BONUS HAND regions and the other one of the first two initial cards in the other of these BONUS HAND regions. Throughout the Blackjack game and method of this invention, it is preferable to focus on the first two initial cards since in many cases there are no more cards dealt to the Blackjack player, than the required minimum of the two initial cards dealt by a Dealer to the Blackjack player. Thus, most payouts for the Blackjack game and method of this invention are directed to the results obtained by the first two initial cards received by the Blackjack player even though the Blackjack player may decide to receive one or more additional cards from the Dealer. The same general rules that are applied to the conventional game of Blackjack also apply to the Blackjack game and method of this invention plus the additional betting options that are provided in the Blackjack game and method of this invention. Thus, the object of the Blackjack game and method of this invention is still to beat the Dealer (or have the Dealer go Bust with the Blackjack player still in the game) and/or to bet on different betting options as set out in the player's betting palette of FIG. 1.

As described above, a bet in either or both of the circular regions associated with the Ace Jack of spades or Ace Jack of clubs means that the Blackjack player is making a bet that the two initial cards that the Blackjack player receives is the Ace and Jack of spades (for the bet placed in the circular region below the Ace Jack in the spade symbol) and/or the Ace and Jack of clubs (if a bet is placed in the circular region below the Ace Jack in the club symbol). Hence, a Blackjack player can bet in either of these "jackpot" circular regions or in both, if desired. The payback for winning for each of these "jackpot" circular regions is the same as the percentages of obtaining such a combination of two cards (in either order of receipt) for each "jackpot" circular region is the same.

Figure 2:
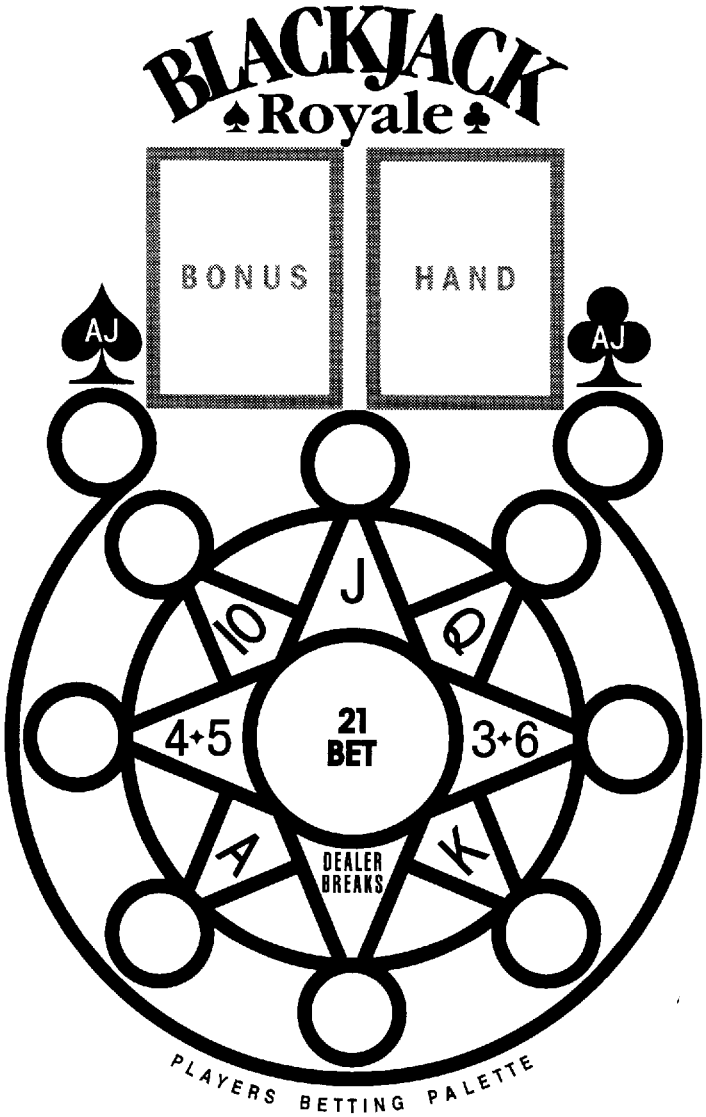
FIG. 2 is a top view similar to the top view of FIG. 1 illustrating the player's betting palette of FIG. 1 plus a listing of bonus hand payouts available to a Blackjack player betting on one or more betting places shown in the player's betting palette located on a table of the Blackjack game and using the method of this invention.

With reference to FIG. 2, the payback is shown for each "jackpot" circular region. Consequently, a One Dollar bet, for example, in the "jackpot" circular region associated with the Ace Jack of spades preferably pays $1,250 (or 1250 to 1) if this Ace Jack (spades) combination for the two initial cards for the Blackjack player is received. Correspondingly, a One Dollar bet in the "jackpot" circular region associated with the Ace Jack of clubs will pay back the Blackjack player with preferably a $1,250 return (1250 to 1) if this Ace Jack (clubs) combination for the two initial cards is received by the Blackjack player.

As shown in FIGS. 1 and 2, a bet placed in the circular region pointed to by the arrow shaped region that contains an A (Ace), or a K (King) or a Q (Queen), or a J (Jack), or a 10 (ten) means that the Blackjack player is placing a bet that the Blackjack player will receive at least one of the two initially received (by the Blackjack player) cards that corresponds to the particular card designation (Ace, King, Queen, Jack or Ten) that is selected by the Blackjack player by placing a bet in the associated circular region. As shown in FIG. 2 a selected single Ten, Jack, Queen, King or Ace received (for either one of the two initial cards received by the Blackjack player) will result in a payback of 5 to 1 which means that the Blackjack player will receive back Five Dollars for each One Dollar bet to receive that card for one of the two initially received cards. However, for the same, for example, One Dollar bet to receive a Ten, Jack, Queen, King or Ace (depending upon which card is selected and bet in the associated circular region by the Blackjack player) a payback of $25 (25 to 1) is achieved if both initial cards are the same numbered card designation of a Ten, Jack, Queen, King or Ace. Hence, a pair of Tens, a pair of Jacks, a pair of Queens, a pair of Kings or a pair of Aces will result in a 25 to 1 payback for the occurrence of this situation if the bet is placed in the appropriate selected circular region.

Selection of receipt of either a 4 or 5 as one of the two initial cards to be received by the Blackjack player (if this is bet on by the Blackjack player) will result in a 2 to 1 payback (Two Dollars for each One Dollar that is bet). If both cards are a 4 or 5 (i.e. two 4s,two 5s or one 4 and one 5) this will result in a payback of 8 to 1 or Eight Dollars for each One Dollar that is bet. Correspondingly, receipt of either a 3 or 6 as one of the two initially received cards that are received by the Blackjack player will result in a 2 to 1 payback if this selection or potion is bet by the Blackjack player. Receipt of two 36, two 6s or one 3 and one 6 as the two initial cards received by the Blackjack player will result in a payback of 8 to 1 like the above described payback odds associated with the 4 and/or 5 selection.

The player's betting palette also illustrates a central circular region for the Blackjack player to place a straight one for one bet to beat the Dealer (this bet can also be won if the Dealer goes Bust provided that the Blackjack player has not previously gone Bust).

Additionally, the player's betting palette also illustrates a Dealer Breaks (or Bust) betting option (see the bottom portion of the player's betting palette of FIGS. 1 and 2). This betting option provides the Blackjack player with a 5 to 2 payback (i.e. Five Dollar return for each Two Dollars bet by the Blackjack player to achieve this result. If a Blackjack player makes this bet, then the Dealer must continue to deal out cards (in accordance with the conventional 21 or Blackjack rules) to the Dealer after all the other Blackjack players have completed play on their hands (even it all of them go Bust).

Figure 3:
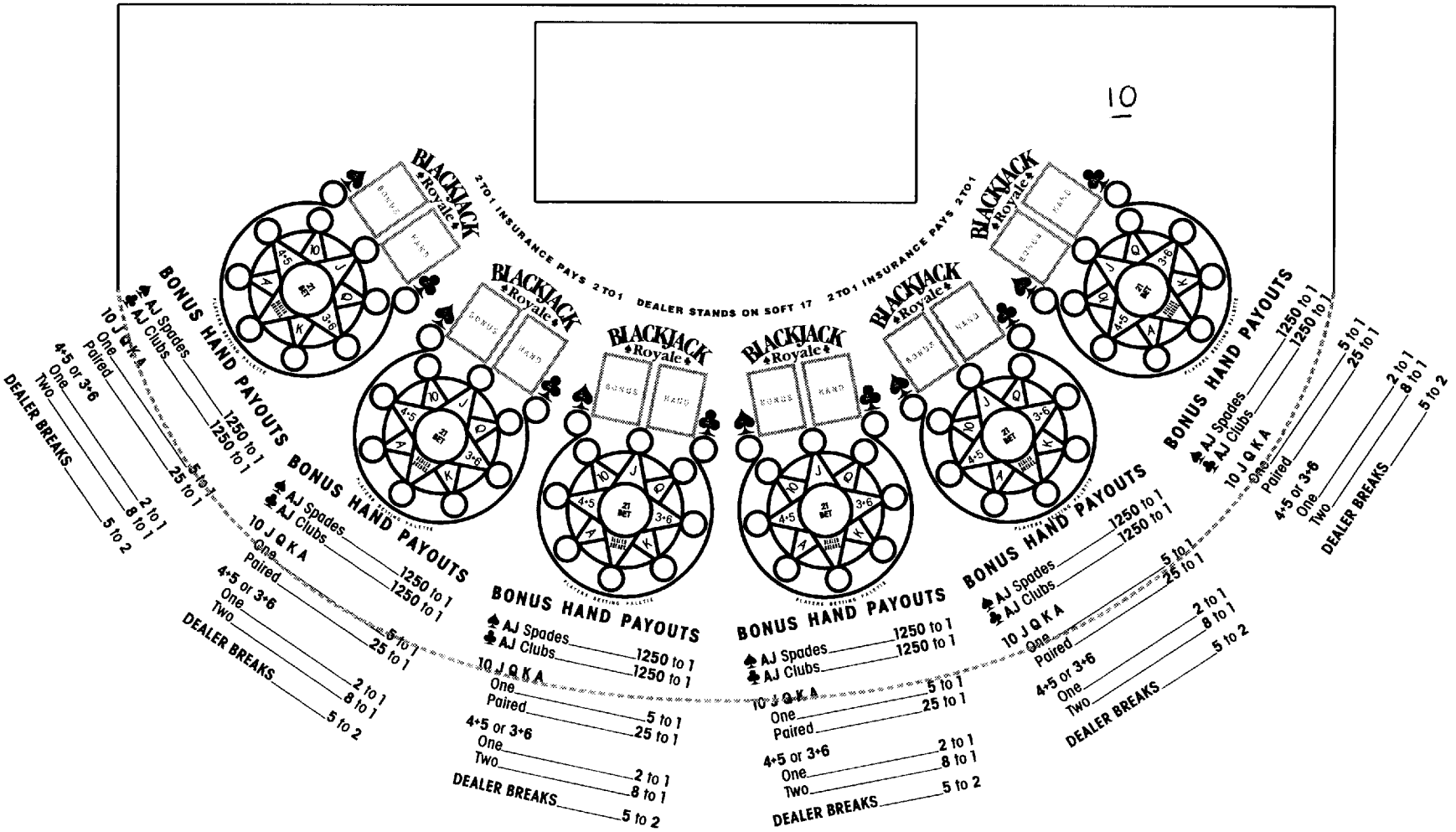
FIG. 3 is a top view similar to the top view of FIGS. 1 and 2 illustrating several (six) players' betting palettes identical to the player's betting palette as shown in FIG. 1 and also illustrating a listing of the bonus hand payouts as shown in FIG. 2 for each of the players betting palettes as they are located on a table of the Blackjack game and using the method of this invention.

FIG. 3 depicts a Blackjack table 10 with, for example, six players betting palettes shown thereon. For ease of viewing, the Bonus Hand Payouts are shown extended beyond the curved edge portion of the table 10, however, in actual use, the Bonus Hand Payouts listing is contained within the bounds of the top surface of the table 10.

The following ODDS TABLES for Blackjack Royale identifies the odds associated with each of the above set out betting options (except for the straight one for one bet to beat the Dealer or the Dealer Break or Bust bet which is the above noted 5 to 2 bet). The first vertical column of the ODDS TABLES for Blackjack Royale sets out the various betting options or propositions. The second vertical column sets out the payback if a single one (hit) of the two initial cards is received for the associated betting proposition or option in the adjacent horizontal area. The third vertical column sets out the payback if a pair (two hits) is achieved for the two initial cards. It should be noted that the third vertical column has different payback options that can be selected by the Casino or House running this Blackjack game. The last or fourth vertical column lists the VIG which is the mathematical percentage return to the Casino or House for the different betting options provided in the Blackjack game and method of this invention. For example, the mathematical percentage return to the Casino or House is 1.36% for the payback odds of 5 to 1 or 25 to 1 (respectively, for one hit of a selected 10, Jack, Queen, King or Ace or for two hits of a selected 10, Jack, Queen, King or Ace). However, if the payback odds by the Casino or House is lowered to 22 to 1 for the two hits of a selected 10, Jack, Queen, King or Ace, then the mathematical percentage return to the Casino or House is increased to 2.72%. Correspondingly, for the payback odds lowered to 20 to 1 or 18 to 1 the respective mathematical return for the Casino or house increases to 3.62% and 4.65%. Similarly, the single hit and double hit designations for the 3-6 or 4-5 betting selections are set forth in this table, however, the mathematical percentage return to the Casino or House increases from 1.36% for either the 2 to 1 or 8 to 1 payback return to the Blackjack player for respective single and double hit occurrences to 3.47% if the payback return to the Blackjack player is lowered to 7 to 1 for double hit occurrences and to 5.58% if the payback return to the Blackjack player is lowered to 6 to 1 for double hit occurrences. The last NATURAL (or jackpot) designation in the table identifies a 5.66% mathematical percentage return to the Casino or House if this betting option is selected by Blackjack players, however, this percentage return to the Casino or House is increased to 9.43% if the payback return to the Blackjack player selecting either the Ace Jack (spade) or (club) betting option for the first two (initial) cards received by the Blackjack player is reduced to 1200 to 1.

ODDS TABLES for Blackjack Rovale

| Proposition | Single Hit | Pair | VIG |
|---|---|---|---|
| A-K-Q-J-T | 5-1 | 25-1 | 1.36% |
| | 5-1 | 22-1 | 2.72% |
| | 5-1 | 20-1 | 3.62% |
| | 5-1 | 18-1 | 4.55% |
| | Pair or 2 Hits | | |
| 3-6 or 4-5 | 2-1 | 8-1 | 1.36% |
| | 2-1 | 7-1 | 3.47% |

-continued

ODDS TABLES for Blackjack Royale

| Proposition | Single Hit | Pair | VIG |
|---|---|---|---|
| | 2-1 | 6-1 | 5.58% |
| NATURAL | 1250-1 | | 5.66% |
| | 1200-1 | | 9.43% |

This Blackjack game (presently identified as Blackjack Royale to designate that it is the highest form of Blackjack) is a 21 game that opens up a new window of betting opportunities for the Blackjack player. It is not just an addition to a 21 game, but is an integrated Blackjack game because of the Bonus Hand and Players Betting Palette as shown in FIGS. 1, 2 and 3. The Bonus Hand and Dealer Breaks or Bust bets provide the Blackjack player with new emphasis and opportunIty on the two most important events in a 21 game; the Blackjack player's first two cards, and the Dealer's hand.

Instead of receiving a conventional 21 hand with one betting unit to be exchanged back and forth between the Dealer and the Blackjack player, depending upon who wins, now Blackjack players are provided, in the same round of play, with three layers of betting opportunities (1) to win one of the Bonus Hand bets, (2) the conventional beat the Dealer 21 bet, and (3) the Dealer Break or Bust bet. All three are interrelated to the outcome of the hand The first two (initial) cards of the Blackjack player's 21 hand are the Bonus Hand. The Players Betting Palette provides players with a range of choices to create their own betting strategy in conjunction with their conventional 21 bet. Players can select the cards they with to receive in the Bonus Hand from the Palette.

The field of selection that is contained in the Player's Betting Palette consists of the best and worst cards players can receive in their hand. Omitted from the Players Betting Palette are the cards least significant to the outcome of the 21 hand; the 2,7,8 and 9.

Players can create their betting strategy by selecting from a positive (10, Jack, Queen, King, Ace) or negative 3-6 or 4-5 or any combination thereof. Players going for the win on all bets in the round of play will favor the high cards to show in the Bonus Hand, while those who like to hedge their 21 bet by getting a payoff on "stiffs", if their luck is running bad, will take the above noted (negative) small cards to show in the Bonus Hand. Because of the many betting opportunities provided by the Blackjack game of this invention, players can still win even if they Bust or break or if the Dealer has a Blackjack, The possibilities are numerous. Regardless of the outcome of the Blackjack player's 21 and Bonus Hand bets, the Blackjack player also has one last great shot to win the round of play by selecting the Dealer Break or Bust bet. Accordingly, all players will enjoy the flexibility of creating their own betting combinations and strategies. This Blackjack Royale game and method is an open architecture of possibilities, left to the discovery and choices of the Blackjack player, BlackJack Royale is preferably to be played on a 21 table using the layout as shown in FIG. 3. Six players can be accommodated, if desired, with each having a playing palette on the table directly in front of them (FIGS. 1 and 2). House rules will specify, for example:

1. A single deck is to be used.
2. All Blackjack player cards are dealt face up.
3. One round is played between shuffles.
4. Dealer must stand on a soft 17 as explained above.
5. Resplitting is not allowed.
6. Of course, they must bet on the standard "Blackjack" (21) game which is played out as part of BlackJack Royale.

Propositions or Betting Options

As explained above, there are three mutually independent nodes of betting in BlackJack Royale.

The 21 BET

As a prerequisite for playing BlackJack Royale, the Blackjack player must make a bet in the Palette on the circle denoted "21 BET". This bet is in accordance with the standard 21 game which is part of BlackJack Royale and is played according to conventional house rules for the standard game. Casino or House limits will determine what the bet may be.

Bonus Hand gets

A Blackjack player may also bet on the cards which the Blackjack player expects will be dealt to the Blackjack player in the first two cards called the Bonus Hand. Bets are placed on the Palette in one (or more) of the preferably 7 betting circles denoted as "4-5", "3-6", "10", "J", "Q", "K", "A". If the Bonus Hand (first two initial cards) contains at least one of the chosen cards, the Blackjack player will be paid the appropriate odds (as set forth in the Palette) for the bet. If the card appears twice, the Blackjack player will be paid at appropriately higher odds for the bet. Since the "3-6" and "4-5" bet wins if either card is in the Bonus Hand, the odds are different from those on the single-card propositions. The Blackjack player may also bet a jackpot (or natural) bet of getting an Ace-Jack in spades and/or an Ace-Jack in clubs.

Bet on Dealer Break or Bust

The Blackjack player may also bet that the Dealer will break or bust their hand (exceed 21) during play. This bet is in action regardless of what the Blackjack player has achieved in playing their hand even if they Break or Bust.

Mathematical Analysis Of The Bonus Hands Odds For The Single Cards (10-J-Q-K-A)

From a single deck of 52 cards, it is possible to deal out 1,326 unique two-card hands when sequence is ignored. Of these, 192 will consist of a particular card appearing once in the initial two card hand (for example, a 10 with any other non-10 card) and 6 will include that card pair paired with another of the same rank. By paying 5-1 on a single card and 25-1 for a pair of the same selected card, the average payouts in 1,326 plays will be $$192\times6+(26\times6)=1{,}308 \text{ producing a vig (see the above ODDS TABLE) of } 18/1{,}326=1.36\%$$

For Receipt At One of Two Cards (3-6 or 4-5)

For the proposition or betting option which provides a betting win on a 3 or 6 (or 4 or 5), there are 352 ways for a particular card to be dealt singularly, 12 ways for pairs and 16 ways for the 3-6 (or 4-5) combinations. By paying 2-1 on a single card and 8-1 on two card combos or pairs, the average payouts in 1,326 plays will be $$352\times3+(28\times9)=1{,}308 \text{ producing a vig of } 18/1{,}326=1.36\%$$

Naturals Or Jackpots (Ace-Jack in Spades or Ace-Jack in clubs)

Since there is only one way each winning NATURAL hand can be dealt, the true odds are 1,325-1 for each. By paying odds of 1,250-1 this proposition or betting option produces a vig of 5.66%

Dealer Break

Using a single deck, and with a rule that the Dealer stands on soft 17's as explained above, the Dealer can be expected to break 26.4% of their hands, assuming that their hand is always played out. By paying 5-2 on this proposition or betting option, the Casino or House has a vig of 0.6% on this proposition or betting option.

Summary

The BlackJack Royale game and method is an attractive and significant improvement to the popular conventional Blackjack (21). The new propositions or betting options are easy to understand and carry low House or Casino Advantages (vigs) which should increase the action for the Blackjack player.

The specific layout and arrangement of the various portions of the player's betting Palette shown in FIG. 1,2 and 3 are particularly advantageous to playing the Blackjack game and method of this invention on a Blackjack table, however, other arrangements and layouts are possible using the concepts disclosed herein. Accordingly, the patent claims defined below are intended to also cover other layouts and arrangements that will use the patented features and steps of this invention.

While the invention has been particularly shown and described with reference to the preferred embodiments thereof, it will be understood by those skilled in the art that the foregoing and other changes in form and details nay be made therein without departing from the spirit and scope of the invention. Furthermore, while the above described Blackjack game and method of this invention is described as played with a single deck of 52 playing cards, multiple decks of playing cards can be also used with or without automatic card shuffling equipment. In the situation where multiple decks are used, then the odds for payback to the Blackjack player will be changed to reflect the fact of the use of multiple decks and in proportion to the number of decks that are used while still preserving a reasonable return to the Casino or House for each betting option. Additionally, if desired, as an additional betting option or incentive to this Blackjack game and method, a separate betting category on the Palette can be used for the Blackjack player to bet for achieving any Ace Jack suited pair of initial cards for the first two initial cards received by the Blackjack player. Obviously, the payback to the Blackjack player betting this option will be lower than the 1250 to 1 payback for betting either the Ace Jack of spades or the Ace Jack of clubs, but this betting option will be higher than the other paybacks noted in the Palette of FIGS. 1, 2, 3.

What is claimed is:

1. A method of playing Blackjack against a Dealer comprising the step of:

providing a Blackjack player with a jackpot betting option to make a bet and have a possibility of winning more than one thousand times the bet made by the Blackjack player; and providing the Blackjack player with additional separate betting options to make a bet on receiving at least one card from an initial two cards received by the Blackjack player equal to one of a 4 and 5, one of a 3 and 6 and a selected one of a 10, a Jack, a Queen, a King and an Ace.

2. The method of claim 1 further comprising the step of:

providing the Blackjack player with a betting option to make a bet on the Dealer going Bust to receive more than a 2 to 1 return to the Blackjack player if this occurs.

3. The method of claim 2 further comprising the step of:

providing the Blackjack player with a betting option to make a straight 1 for 1 bet to beat the Dealer.

4. The method of claim 1 wherein the jackpot betting option creates the possibility of winning about 1250 times the bet made by the Blackjack player.

5. The method of claim 1 wherein one of the betting options to receive at least one card from an initial two cards received by the Blackjack player equal to one of a 4 and 5 creates a possibility of winning about 2 times the bet made by the Blackjack player for this specific option.

6. The method of claim 5 wherein a possibility of winning about 8 times the beg made by the Blackjack player to receive at least one of a 4 and 5 is achieved if both initial cards received by the Blackjack player are equal to one of a 4 and 5.

7. The method of claim 1 wherein one of the betting options to receive at least one card from an initial two cards received by the Blackjack player equal to one of a 3 and 6 creates a possibility of winning about 2 times the bet made by the Blackjack player.

8. The method of claim 7 wherein a possibility of winning about 8 times the bet made by the Blackjack player is achieved if both initial cards received by the Blackjack player are equal to one of a 3 and 6.

9. The method of claim 1 wherein one of the betting options to receive at least one card from an initial two cards received by the Blackjack player equal to one of a 10, a Jack, a Queen, a King and an Ace creates a possibility of winning about 5 times the bet made by the Blackjack player for this specific option.

10. The method of claim 9 wherein a possibility of winning about 25 times the bet made by the Blackjack player is achieved if both initial cards received by the Blackjack player are equal to the selected one of a 10, a Jack, a Queen, a King and an Ace.

11. The method of claim 1 wherein the jackpot betting option is created by the Blackjack player separately betting on receiving both initial cards to be one of an Ace and Jack of Spades and an Ace and Jack of clubs.

12. A method of playing Blackjack against the Dealer comprising the steps of:

providing a Blackjack player with separate betting options to make a bet on receiving at least one card from an initial two cards received by the Blackjack player equal to one of a 4 and 5, one of a 3 and 6 and a selected one of a 10, a Jack, a Queen, a King and an Ace.

13. The method of claim 12 further comprising the step of:

providing the Blackjack player with a betting option to make a bet on the Dealer going Bust to receive more than a 2 to 1 return to the Blackjack player if this occurs.

14. The method of claim 13 further comprising the step of:

providing the Blackjack player with a betting option to make a straight 1 for 1 bet to beat the Dealer.

15. The method of claim 12 wherein one of the betting options to receive at least one card from an initial two cards received by the Blackjack player equal to one of a 4 and 5 creates a possibility of winning about 2 times the bet made by the Blackjack player for this specific option.

16. The method of claim 15 wherein a possibility of winning about 8 times the bet made by the Blackjack player to receive at least one of a 4 and 5 is achieved if both initial cards received by the Blackjack player are equal to one of a 4 and 5.

17. The method of claim 12 wherein one of the betting options to receive at least one card from an initial two cards received by the Blackjack player equal to one of a 3 and 6 creates a possibility of about winning 2 times the bet made by the Blackjack player.

18. The method of claim 17 wherein a possibility of winning about 8 times the bet made by the Blackjack player is achieved if both initial cards received by the Blackjack player are equal to one of a 3 and 6.

19. The method of claim 12 wherein one of the betting options to receive at least one card from an initial two cards received by the Blackjack player equal to one of a 10, a Jack, a Queen, a King and an Ace creates a possibility of winning about 5 times the bet made by the Blackjack player for this specific option.

20. The method of claim 19 wherein a possibility of winning about 25 times the bet made by the Blackjack player is achieved if both initial cards received by the Blackjack player are equal to the selected one of a 10, a Jack, a Queen, a King and an Ace.

21. A method of playing Blackjack against a Dealer comprising the step of:

providing a Blackjack player with separate betting options to make a bet on receiving at least one card from an initial two cards received by the Blackjack player equal to one of a 4 and 5 and one of a 3 and 6.

22. The method of claim 21 further comprising the step of:

providing the Blackjack player with a betting option to make a bet on the Dealer going Bust to receive more than a 2 to 1 return to the Blackjack player if this occurs.

23. The method of claim 22 further comprising the step of:

providing the Blackjack player with a betting option to make a straight 1 for 1 bet to beat the Dealer.

24. The method of claim 21 wherein one of the betting options to receive at least one card from an initial two cards received by the Blackjack player equal to one of a 4 and 5 creates a possibility of winning about 2 times the bet made by the Blackjack player for this specific option.

25. The method of claim 24 wherein a possibility of winning about 8 times the bet made by the Blackjack player to receive at least one of a 4 and 5 is achieved if both initial cards received by the Blackjack player are equal to one of a 4 and 5.

26. The method of claim 21 wherein one of the betting options to receive at least one card from an initial two cards received by the Blackjack player equal to one of a 3 and 6 creates a possibility of winning about 2 times the bet made by the Blackjack player.

27. The method of claim 26 wherein a possibility of winning about 8 times the bet made by the Blackjack player is achieved if both initial cards received by the Blackjack player are equal to one of a 3 and 6.

28. A method of playing Blackjack against a Dealer comprising the step of:

providing a Blackjack player with a betting option to make a bet on receiving at least one card from an initial two cards received by the Blackjack player equal to one of a 4 and 5.

29. The method of claim 28 further comprising the step of:

providing the Blackjack player with a betting option to make a bet on the Dealer going Bust to receive more than a 2 to 1 return to the Blackjack player if this occurs.

30. The method of claim 29 further comprising the step of:

providing the Blackjack player with a betting option to make a straight 1 for 1 bet to beat the Dealer.

31. The method of claim 28 wherein the betting option to receive at least one card from an initial two cards received by the Blackjack player equal to one of a 4 and 5 creates a possibility of winning about 2 times the bet made by the Blackjack player for this specific option.

32. The method of claim 31 wherein a possibility of winning about 8 times the bet made by the Blackjack player to receive at least one of a 4 and 5 is achieved if both initial cards received by the Blackjack player are equal to one of a 4 and 5.

33. A method of playing Blackjack against a Dealer comprising the step of:

providing a Blackjack player with a betting option to make a bet on receiving at least one card from an initial two cards received by the Blackjack player equal to one of a 3 and 6.

34. The method of claim 33 further comprising the step of:

providing the Blackjack player with a betting option to make a bet on the Dealer going Bust to receive more than a 2 to 1 return to the Blackjack player if this occurs.

35. The method of claim 34 further comprising the step of:

providing the Blackjack player with a betting option to make a straight 1 for 1 bet to beat the Dealer.

36. The method of claim 33 wherein the betting option to receive at least one card from an initial two cards received by the Blackjack player equal to one of a 3 and 6 creates a possibility of winning about 2 times the bet made by the Blackjack player.

37. The method of claim 36 wherein a possibility of winning about 8 times the bet made by the Blackjack player is achieved if both initial cards received by the Blackjack player are equal to one of a 3 and 6.

38. A Blackjack card game comprising in combination:

a Blackjack card table having a betting layout located on a surface portion of said Blackjack card table;

said betting layout comprising a betting region for a Blackjack player to make a jackpot bet having a possibility of winning more than one thousand times the bet made by the Blackjack player, said betting layout having additional separate betting means for a Blackjack player to make a bet on receiving at least one card from an initial two cards received by the Blackjack player equal to one of a 4 and 5, one of a 3 and 6, and a selected one of a 10, a Jack, a Queen, a King and an Ace.

39. The Blackjack card game of claim 38 wherein said betting layout having a separate betting region for a Blackjack player to make a bet on a Dealer going Bust to receive more than a 2 to 1 return to the Blackjack player if this occurs.

40. The Blackjack card game of claim 39 wherein said betting layout having a separate betting region for a Blackjack player to make a straight 1 for 1 bet to beat the Dealer.

41. The Blackjack card game of claim 38 wherein said jackpot bet having a possibility of winning about 1250 times the jackpot bet made by the Blackjack player.

42. The Blackjack card game of claim 38 wherein the separate betting means for a Blackjack player to make a bet on receiving at least one card from an initial two cards received by the Blackjack player equal to one of a 4 and 5 creates a possibility of winning about 2 times the bet made by the Blackjack player betting on this separate betting region.

43. The Blackjack card game of claim 42 wherein the Blackjack player can receive about 8 times the bet made by the Blackjack player on the separate betting region to receive at least one of a 4 and 5 if both initial cards received by the Blackjack player are equal to one of a 4 and 5.

44. The Blackjack card game of claim 38 wherein the separate betting means for a Blackjack player to make a bet on receiving at least one card from an initial two cards received by the Blackjack player equal to one of a 3 and 6 creates a possibility of winning about 2 times the bet made by the Blackjack player betting on this separate betting region.

45. The Blackjack card game of claim 44 wherein the Blackjack player can receive about 8 times the bet made by the Blackjack player on the separate betting region to receive at least one of a 3 and 6 if both initial cards received by the Blackjack player are equal to one of a 3 and 6.

46. The Blackjack card game of claim 38 wherein each of the separate betting means for a Blackjack player to make a bet on receiving at least one card from an initial two cards received by the Blackjack player equal to a selected one for each of said separate betting regions of a 10, a Jack, a Queen, a King and an Ace creates a possibility of winning about 5 times the bet made by the Blackjack player betting on each of the separate betting regions.

47. The Blackjack card game of claim 46 wherein the Blackjack player can receive about 25 times the bet made by the Blackjack player if both initial cards received by the Blackjack player betting on said each of the separate betting regions is equal to the selected one of a 10, a Jack, a Queen, a King and an Ace.

48. The Blackjack card game of claim 38 wherein the betting means for a Blackjack player to make a jackpot bet comprises two separate jackpot betting regions with one of the two separate jackpot betting regions is for the Blackjack player to bet on receiving an Ace and Jack of Spades for both initial cards received by the Blackjack player and the other of the two separate jackpot betting regions is for the Blackjack player to bet on receiving an Ace and Jack of Clubs for both initial cards received by the Blackjack player.

49. A Blackjack card game comprising, in combination:

a Blackjack card table having a betting layout located on a surface portion of said Blackjack card table;

said betting layout comprising separate betting means for a Blackjack player to make a bet on receiving at least one card from an initial two cards received by the Blackjack player equal to one of a 4 and 5, one of a 3 and 6 and a selected one of a 10, a Jack, a Queen, a King and an Ace.

50. The Blackjack card game of claim 49 wherein said betting layout having a separate betting region for a Blackjack player to make a bet on a Dealer going Bust to receive more than a 2 to 1 return to the Blackjack player if this occurs.

51. The Blackjack card game of claim 50 wherein said betting layout having a separate betting region for a Blackjack player to make a straight 1 for 1 bet to beat the Dealer.

52. The Blackjack card game of claim 49 wherein the separate betting means for a Blackjack player to make a bet on receiving at least one card from an initial two cards received by the Blackjack player equal to one of a 4 and 5 creates a possibility of winning about 2 times the bet made by the Blackjack player betting on this separate betting region.

53. The Blackjack card game or claim 52 wherein the Blackjack player can receive about 8 times the bet made by the Blackjack player on the separate betting region to receive at least one of a 4 and 5 if both initial cards received by the Blackjack player are equal to one of a 4 and 5.

54. The Blackjack card game of claim 49 wherein the separate betting means for a Blackjack player to make a bet on receiving at least one card from an initial two cards received by the Blackjack player equal to one of a 3 and 6 creates a possibility of winning about 2 times the bet made by the Blackjack player betting on this separate betting region.

55. The Blackjack card game of claim 54 wherein the Blackjack player can receive about 8 times the bet made by the Blackjack player on the separate betting region to receive at least one of a 3 and 6 if both initial cards received by the Blackjack are equal to one of a 3 and 6.

56. The Blackjack card game of claim 49 wherein each of the separate betting means for a Blackjack player to make a bet on receiving at least one card from an initial two cards received by the Blackjack player equal to a selected one for each of said separate betting regions of a 10, a Jack, a Queen, a King and an Ace creates a possibility of winning about 5 times the bet made by the Blackjack player betting on each of the separate betting regions.

57. The Blackjack card game of claim 56 wherein the Blackjack player can receive about 25 times the bet made by the Blackjack player if both initial cards received by the Blackjack player betting on said each of the separate betting regions is equal to the selected one of a 10, a Jack, a Queen, a King and an Ace.

58. A Blackjack card game comprising, in combination:

a Blackjack card table having a betting layout located on a surface portion of said Blackjack card table;

said betting layout comprising a separate betting means for a Blackjack player to make a bet on receiving at least one card from an initial two cards received by the Blackjack player equal to one of a 4 and 5 and another separate region for the Blackjack player to make a bet on receiving at least one card from an initial two cards received by the Blackjack player equal to one of a 3 and 6.

59. The Blackjack card game of claim 58 wherein said betting layout having a separate betting region for a Blackjack player to make a bet on a Dealer going Bust to receive more than a 2 to 1 return to the Blackjack player if this occurs.

60. The Blackjack card game of claim 59 wherein said betting layout having a separate betting region for a Blackjack player to make a straight 1 for 1 bet to beat the Dealer.

61. The Blackjack card game of claim 58 wherein the separate betting means for a Blackjack player to make a bet on receiving at least one card from an initial two cards received by the Blackjack player equal to one of a 4 and 5 creates a possibility of winning about 2 times the bet made by the Blackjack player betting on this separate betting region.

62. The Blackjack card game of claim 61 wherein the Blackjack player can receive about 8 times the bet made by the Blackjack player on the separate betting region to receive at least one of a 4 and 5 if both initial cards received by the Blackjack player are equal to one of a 4 and 5.

63. The Blackjack card game of claim 58 wherein the separate betting region for a Blackjack player to make a bet on receiving at least one card from an initial two cards received by the Blackjack player equal to one of a 3 and 6 creates a possibility of winning about 2 times the bet made by the Blackjack player batting on this separate betting region.

64. The Blackjack card game of claim 63 wherein the Blackjack player can receive about 8 times the bet made by the Blackjack player on the separate betting region to receive at least one at a 3 and 6 it both initial cards received by the Blackjack player are equal to one of a 3 and 6.

65. A Blackjack card game comprising, in combination:

a Blackjack card table having a betting layout located on a surface portion of said Blackjack card table;

said betting layout comprising a separate betting means for a Blackjack player to make a bet on receiving at least one card from an initial two cards received by the Blackjack player equal to one of a 4 and 5.

66. The Blackjack card game of claim 65 wherein said betting layout having a separate betting region for a Blackjack player to make a bet on a Dealer going Bust to receive more than a 2 to 1 return to the Blackjack player if this occurs.

67. The Blackjack card game of claim 66 wherein said betting layout having a separate betting region for a Blackjack player to make a straight 1 for 1 bet to beat the Dealer.

68. The Blackjack card game of claim 65 wherein the separate betting means for a Blackjack player to make a bet on receiving at least one card from an initial two cards received by the Blackjack player equal to one of a 4 and 5 creates a possibility of winning about 2 times the bet made by the Blackjack player betting on this separate betting region.

69. The Blackjack card game of claim 68 wherein the Blackjack player can receive about a times the bet made by the Blackjack player on the separate betting region to receive at least one of a 4 and 5 if both initial cards received by the Blackjack player are equal to one of a 4 and 5.

70. A Blackjack card game comprising, in combination:

a Blackjack card table having a betting layout located on a surface portion of said Blackjack card table;

said betting layout comprising a separate betting means for a Blackjack player to make a bet on receiving at least one card from an initial two cards received by the Blackjack player equal to one of a 3 and 6.

71. The Blackjack card game of claim 70 wherein said betting layout having a separate betting region for a Blackjack player to make a bet on a Dealer going Bust to receive more than a 2 to 1 return to the Blackjack player if this occurs.

72. The Blackjack card game of claim 71 wherein said betting layout having a separate betting region for a Blackjack player to make a straight 1 for 1 bet to beat the Dealer.

73. The Blackjack card game of claim 70 wherein the separate betting means for a Blackjack player to make a bet on receiving at least one card from an initial two cards received by the Blackjack player equal to one of a 3 and 6 creates a possibility of winning about 2 times the bet made by the Blackjack player betting on this separate betting region.

74. The Blackjack card game of claim 73 wherein the Blackjack player can receive about 8 times the bet made by the Blackjack player on the separate betting region to receive at least one of a 3 and 6 if both initial cards received by the Blackjack player are equal to one of a 3 and 6.

75. A Blackjack card game comprising, in combination:

a Blackjack card table having a betting layout located on a surface portion of said Blackjack card table;

said betting layout comprising separate betting means for a Blackjack player to make a bet on receiving at least one card from an initial two cards received by the Blackjack player equal to a selected one for each of said separate betting means of a 10, a Jack, a Queen, a King and an Ace.

76. The Blackjack card game of claim 75 wherein said betting layout having a separate betting region for a Blackjack player to make a bet on a Dealer going Bust to receive more than a 2 to 1 return to the Blackjack player if this occurs.

77. The Blackjack card game of claim 76 wherein said betting layout having a separate betting region for a Blackjack player to make a straight 1 for 1 bet to beat the Dealer.

78. The Blackjack card game of claim 75 wherein each of the separate betting means for a Blackjack player to make a bet on receiving at least one card from an initial two cards received by the Blackjack player equal to a selected one for each of said separate betting regions of a 10, a Jack, a Queen, a King and an Ace creates a possibility of winning about 5 times the bet made by the Blackjack player betting on each of the separate betting regions.

79. The Blackjack card game of claim 78 wherein the Blackjack player can receive about 25 times the bet made by the Blackjack player if both initial cards received by the Blackjack player betting on said each of the separate betting regions is equal to the selected one of a 10, a Jack, a Queen, a King and an Ace.

80. A method of playing Blackjack against a Dealer comprising the step of:

providing a Blackjack player with a betting option to make a bet on receiving at least one card from an initial two cards received by the Blackjack player equal to a selected one of a 10, a Jack, a Queen, a King and an Ace.

81. The method of claim 80 further comprising the step of:

providing the Blackjack player with a betting option to make a bet on the Dealer going Bust to receive more than a 2 to 1 return to the Blackjack player if this occurs.

82. The method of claim 81 further comprising the step of:

providing the Blackjack player with a betting option to make a straight 1 for 1 bet to beat the Dealer.

83. The method of claim 80 wherein the betting option to make a bet on receiving at least one card from an initial two cards received by the Blackjack player equal to one of a 10, a Jack, a Queen, a King and an Ace creates a possibility of winning about 5 times the bet made by the Blackjack player.

84. The method of claim 83 wherein a possibility of winning about 25 times the bet made by the Blackjack player is achieved if both initial cards received by the Blackjack player are equal to the selected one of a 10, a Jack, a Queen, a King and an Ace.

* * * * *